US005117881A

United States Patent [19]

Simpson

[11] Patent Number: 5,117,881

[45] Date of Patent: Jun. 2, 1992

[54] PRESSURE CONTROL SYSTEM FOR RING DEBARKERS WITH ROTARY CUTTERS

[75] Inventor: George B. Simpson, Sumner, Wash.

[73] Assignee: Nicholson Manufacturing Company, Seattle, Wash.

[21] Appl. No.: 702,192

[22] Filed: May 14, 1991

[51] Int. Cl.[5] ..... B27L 1/00

[52] U.S. Cl. ..... 144/341; 144/208 E

[58] Field of Search ..... 144/2 Z, 208 R, 208 E, 144/341

[56] References Cited

U.S. PATENT DOCUMENTS

| | | | |
|---|---|---|---|
| 2,779,363 | 1/1957 | Laughton | 144/208 E |
| 2,799,304 | 7/1957 | Stewart | 144/208 E |
| 3,789,893 | 2/1974 | Carson | 144/208 E |
| 3,913,644 | 10/1975 | Braun | 144/208 E |
| 4,303,111 | 12/1981 | Neville | 144/208 E |

*Primary Examiner*—W. Donald Bray
*Attorney, Agent, or Firm*—Seed and Berry

[57] ABSTRACT

A ring debarker has counterbalanced swing arms on which rotary cutters are mounted. The counterbalancing of the swing arms is such that the centrifugal and gravitational forces on the swing arms as they rotate around a log being debarked are substantially neutralized so that debarking pressure exerted on the cutters can be accurately controlled by controlling air pressure used to bias the swing arms.

4 Claims, 3 Drawing Sheets

PRESSURE CONTROL SYSTEM FOR RING DEBARKERS WITH ROTARY CUTTERS

TECHNICAL FIELD

The present invention relates to ring debarkers of the type in which rotary cutters are mounted on swing arms for engaging the bark on logs passing through the debarker ring and, more particularly, relates to the control of the debarking pressure exerted on the rotary cutters and increasing the output of the debarkers.

BACKGROUND OF THE INVENTION

Ring debarkers with rotary cutters are particularly adapted for debarking logs with long fibers, such as cedar. Accurate control of the pressure on the cutters is required for effective debarking without damaging the log surface beneath the bark. As the debarker ring rotates, each swing arm and respective rotary cutter are effected by centrifugal and gravity forces. During each rotation of the ring, the effect of gravity on each arm changes because the orientation of the arm varies between horizontal and vertical positions. It has been found that the resulting variance in force exerted by the cutters acting on the bark is significant to debarking performance, even though, in the past, the debarking arms have been biased by air cylinders to swing inwardly with respect to the ring to compensate for centrifugal force and provide a net debarking force on the rotary cutters.

SUMMARY OF THE INVENTION

In accordance with the present invention, each swing arm on the debarker ring is provided with an extension on the opposite side of the swing axis from the respective rotary cutter, and a counterbalancing weight is mounted on the extension. The weight is selected to closely offset the centrifugal and gravitational forces otherwise acting on the arm and rotary cutter so that the air cylinder acting on the arm provides substantially all of the debarking force exerted on the rotary cutter. The result is that control of the pressure in the air cylinders acting on the arms can be relied upon for accurate control of the debarking force on the rotary cutters. It will be appreciated that this arrangement differs in concept from the prior use of counterweights on ring debarkers with scraper-type tools on the swing arms, where the counterweights were made with sufficient weight to provide a net inward force acting on the debarking tools which was sufficient to provide a major portion of the debarking force.

IN THE DRAWINGS

DETAILED DESCRIPTION OF THE INVENTION

Figure 2:
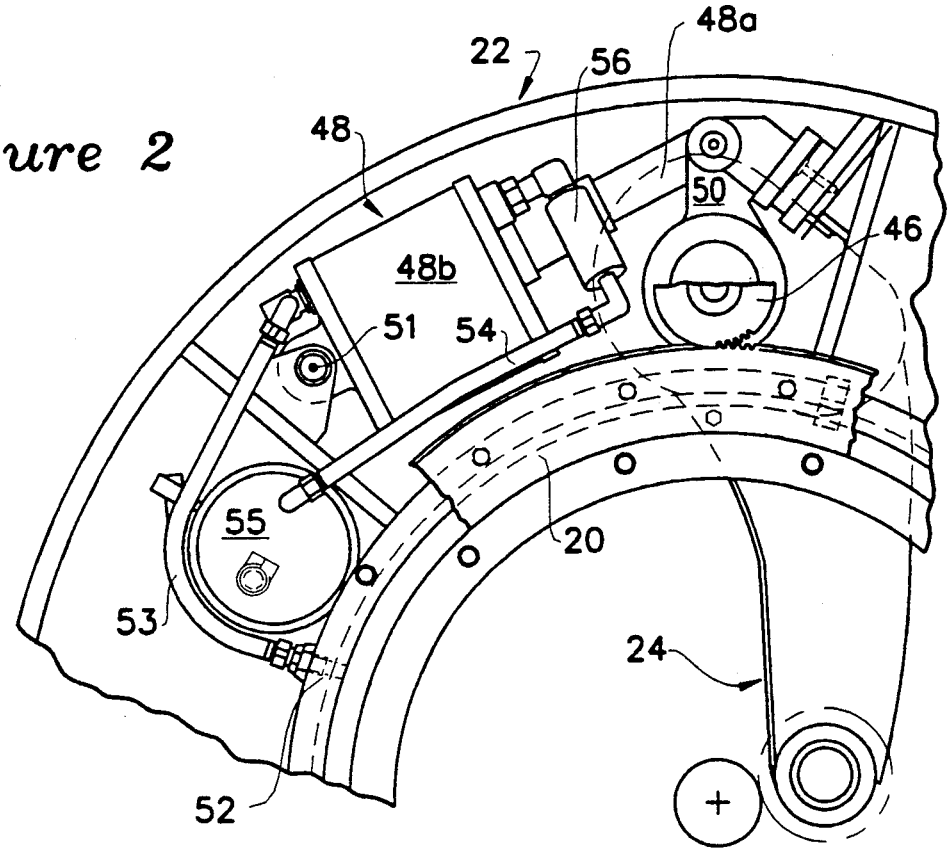
FIG. 2 is a fragmentary rear elevational view of the ring.
Figure 1:
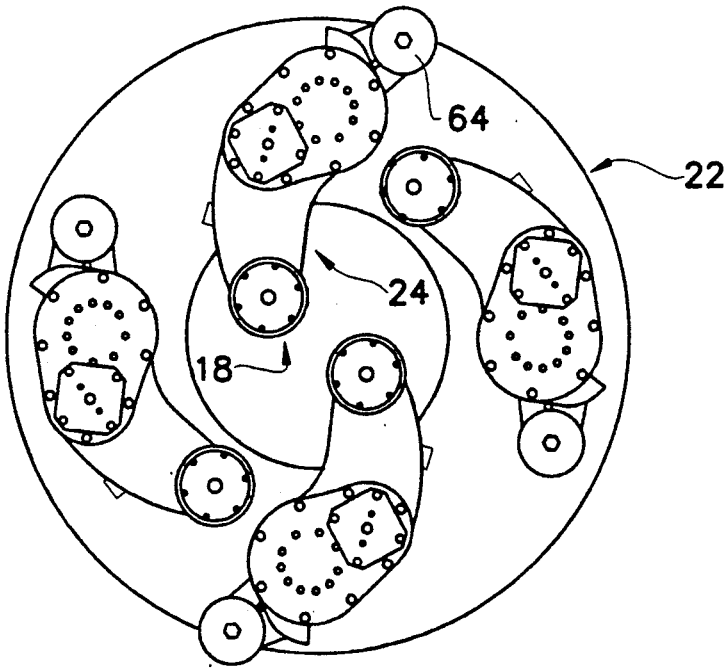
FIG. 1 is a front view of a ring debarker embodying the present invention, and showing two swing arms in debarking position and another two in retracted position.
Figure 3:
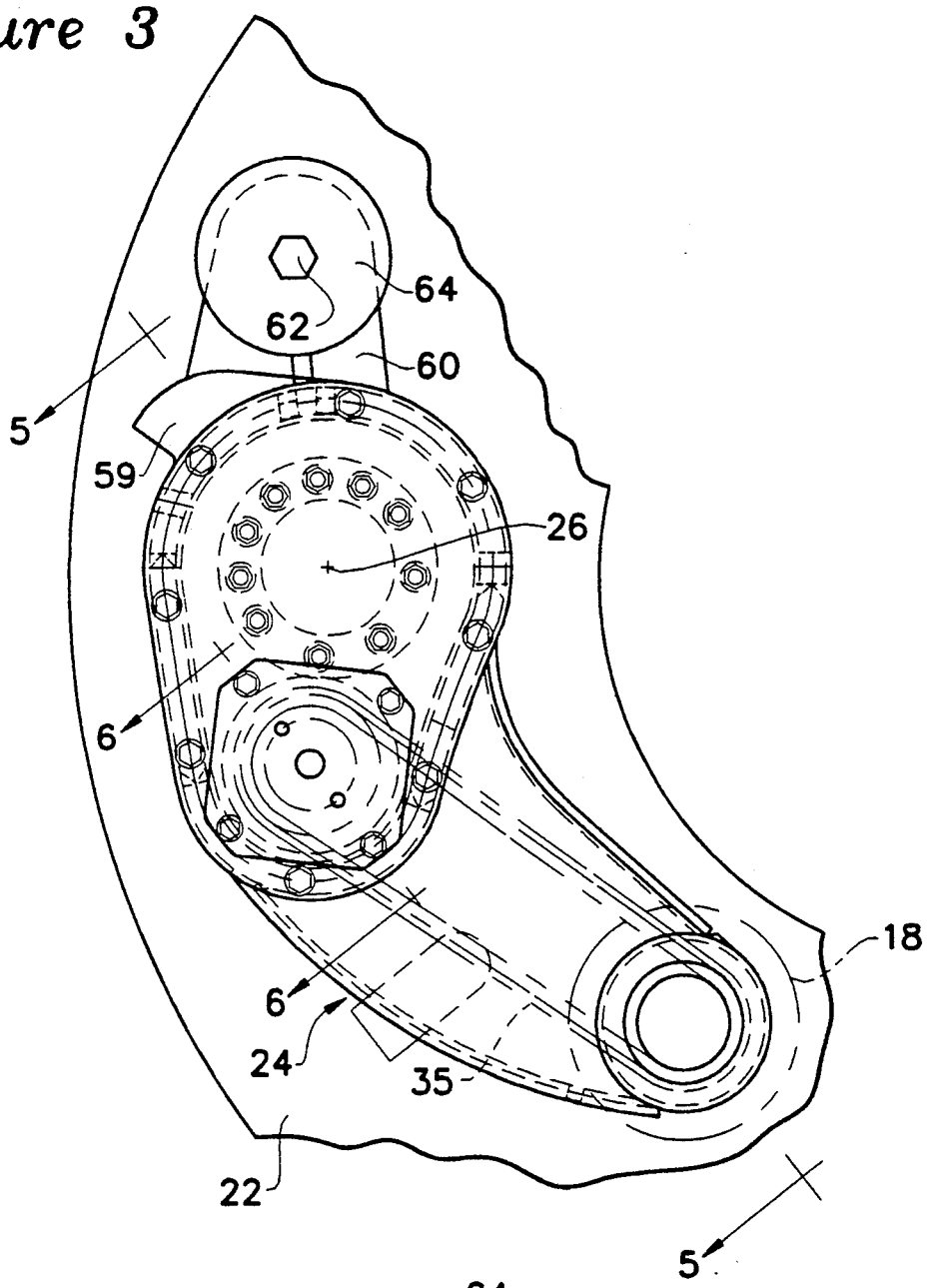
FIG. 3 is a front elevational view to an enlarged scale of one of the debarker arms in retracted position.
Figure 4:
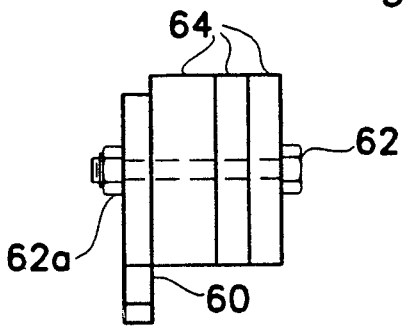
FIG. 4 is a side elevational view of one of the counterweights.
Figure 5:
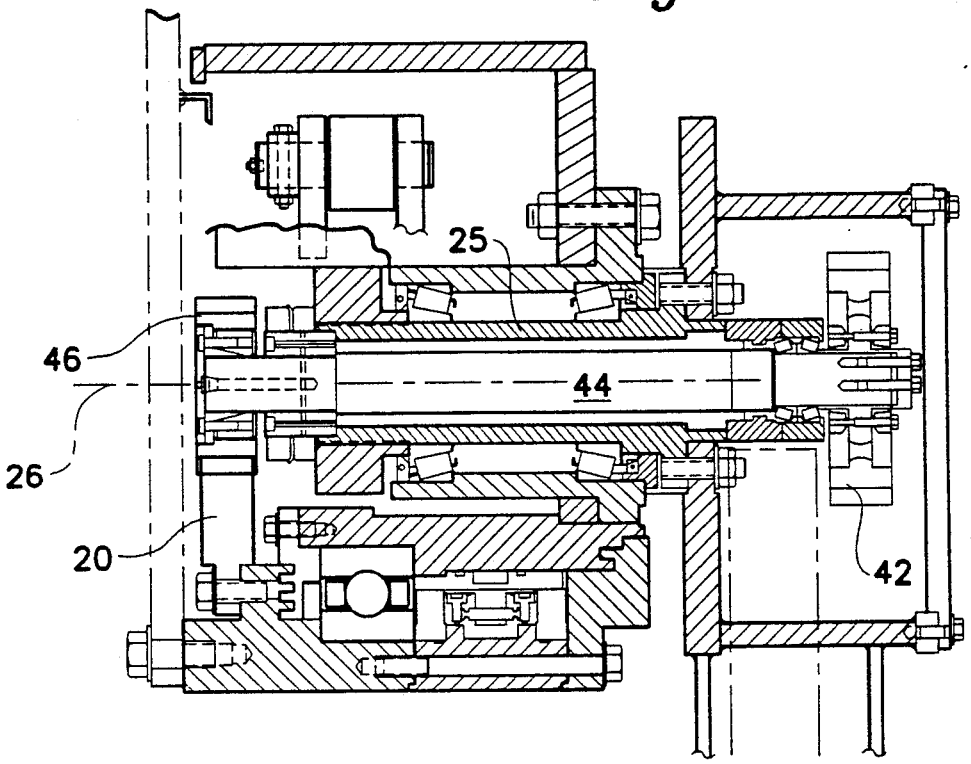
FIG. 5 is a fragmentary sectional view though one of the swing arms taken as indicated by line 25-5 in FIG. 3.
Figure 5:
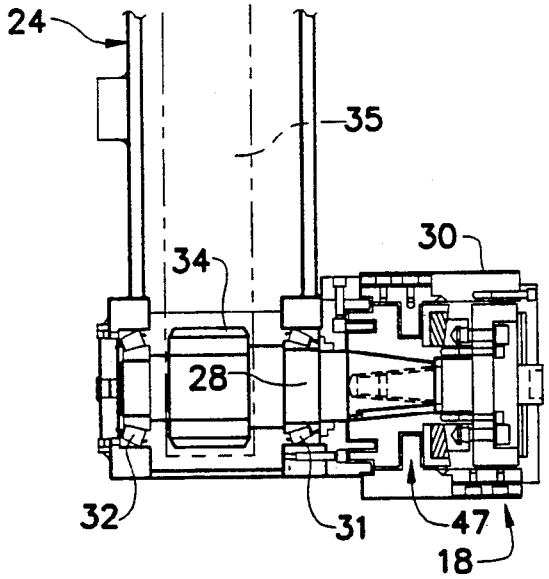
Figure 6:
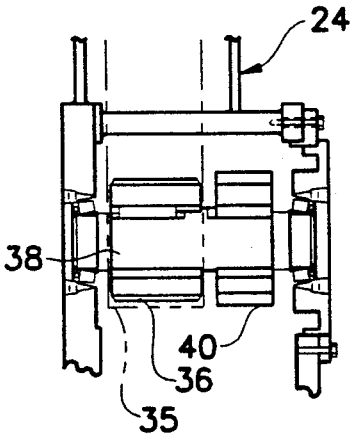
FIG. 6 is a further fragmentary sectional view of the swing arm taken as indicated by line 6—6 in FIG. 3.

The usual drive to the rotary cutter units 18 on a ring debarker of the type to which this invention relates involves a stationary sun gear 20 coaxial with a rotating debarker ring 22. Swing arms 24 are pivotally mounted on the ring 22 by hollow pivot shafts 25 to swing about a respective swing axis 26. Each swing arm takes the form of an elongated housing having a stub shaft 28 projected therefrom near its outer end, on which one of the rotary cutter units 18 is mounted presenting elongated cutting teeth 30. A suitable cutter unit 18 is disclosed in copending application Ser. No. 07/640,055, filed Jan. 11, 1991. The stub shaft 28 is tapered at its projecting end and is journaled by a pair of bearings 31, 32 between which a sprocket 34 is mounted on the stub shaft. A chain 35 extends from this sprocket 34 to a sprocket 36 on an intermediate shaft 38 which also has an idler gear 40 meshing with a gear 42 mounted on a drive shaft 44 extending through the pivot shaft 26. The opposite end of this drive shaft carries a planet gear 46 traveling around the sun gear 20.

The ratio of the sun gear 26 to the planet gears 46 provides most of the speed build-up for the rotary cutters 18, and may be augmented by the ratio of the gears 40, 42 and of the sprockets 34, 36. The primary function of the idler gear 38 and related sprocket 36 on each swing arm is to reverse the rotation of the rotary cutters 18 relative to that of the planet gears 46 so that when the debarker ring 22 is powered to turn in a clockwise direction, for example, the rotary cutters 18 will be turning counterclockwise. A slip clutch mechanism 47 is provided at each rotary cutter or elsewhere in the drive train for overload protection.

Each swing arm 24 is biased by a respective air cylinder unit 48 in the ring 22 having its piston rod **48*a* pivotally connected to a crank 50 and its cylinder 48*b* pivotally connected at 51 to the ring 22. The crank 50 projects within the ring 22 from the inner end of the respective pivot shaft 25. Pressurized air is supplied to the cylinder units 48 from a stationary control panel through a sealed annular chamber 52 at the inner side of the ring 22. Flexible hoses 53 extend from the air chamber 52 to one end of the cylinders 48*b*. At the opposite end of the cylinders 48*b*, the cylinders connect by hoses 54 to air tanks 55 via flow control valves 56. The control panel contains control valves for controlling the operation of the cylinder units 48 to engage and retract the rotary cutters 30 and vary the air pressure to responsively control the pressure exerted by the cylinder units on the rotary cutters via the cranks 50, pivot shafts 26 and swing arms 24**.

During a log debarking operation the log is fed by a suitable conveyor lengthwise into the ring 22 and the arms 24 are swung inwardly from an outer retracted position into debarking position by feeding compressed air through the control valve 58 to the ring 22 for charging the air cylinder units 48. As the cylinders **48*b* are pressurized, the pressurized air causes the cylinder rods to extend, in turn causing the arms 24 to swing inwardly until the rotary cutters 30 engage the bark on the advancing log. Thereafter, as the log advances the cutters 30 remove the bark as they move around the log with the rotating ring 22 in a spiral cutting pattern. Preferably, the advancing speed of the log is coordinated with the rotational speed of the ring so that the cutters 30 travel over the entire peripheral surface of the log. When the log exits from the ring 22 the swing arms 24 are retracted by venting the ring chamber 52 and air cylinders through the control valves in the control panels. As this venting occurs, the centrifugal force acting on the rotary cutter arms 24** causes the arms to swing outwardly into retracted position.

The overall arrangement thus far described is prior art. In accordance with the present invention, each swing arm 24 is provided with a fin 59 to which is connected an extension member 60 which projects oppositely of the arm's swing axis from the cutter units 18. Each extension 60 has a mounting stud 62 on which one or more counterweights 64 are mounted and retained by a nut 62*a*. The total counterweight for each swing arm 24 is selected such that the swing arm and related mechanism is substantially neutralized as respects the effect thereon of centrifugal and gravitational forces during rotation of the ring 22. The result is that the air cylinder units 48 can be utilized to exert a substantially uniform debarking force on the rotary cutters 18 throughout an entire rotation of the ring 22 about the log being debarked.

As an example, when the debarker ring 22 has an inside diameter of 35 inches, and the swing arms and internal mechanism offset from the swing axis have a combined weight of 300 pounds with a center of gravity offset from the swing axis by 11 inches, the counterweight may be 100 pounds spaced 10 inches from the swing axis.

I claim:

1. An improvement in ring debarkers of the type which have rotary cutters mounted on swing arm units which are swing mounted on the rotary ring of the debarker, and which have air cylinder units mounted on the debarker ring for acting on the swing arm units responsive to remotely supplied pressurized air, said improvement comprising:

counterbalances mounted on the swing arm units so that centrifugal and gravitational forces otherwise acting on the rotary cutters during rotation of said ring are substantially neutralized; and control means for selectively supplying and venting pressurized air to said air cylinder units and for controlling the pressure of said air to thereby responsively control the debarking pressure on the rotary cutters.

2. In a ring debarker:

a ring for receiving therethrough a log to be debarked;

means for rotating the ring;

an arm swingably mounted intermediate its ends on said ring and having a counterweight at one of its ends;

a rotary debarking tool journal-mounted for rotation adjacent the other end of said arm;

means for rotating said tool response to rotation of said ring;

ring biasing means mounted on the ring for urging said arm to swing inwardly into a debarking position with a debarking pressure; and said counterweight balancing centrifugal and gravitational forces on said tool such that said biasing means determines substantially the entire debarking pressure acting on said tool.

3. In a ring debarker according to claim 2, said biasing means comprising an air cylinder unit mounted on said ring and operatively associated with said arm for swinging it inwardly toward the center of the ring responsive to extension of the air cylinder unit, and means for selectively providing air at a controlled pressure to said cylinder unit and for selectively venting said cylinder unit.

4. A method of controlling the debarking pressure on the rotary cutters mounted on the swing arm units of a ring debarker of the rotary cutter type, said method comprising:

counterbalancing the swing arm units so that the centrifugal and gravitational forces otherwise acting on the rotary cutters during rotation of the debarker ring are substantially neutralized; and controlling the air pressure in air cylinder units mounted on said ring and acting on the swing arm units to thereby responsively control the debarking pressure on the rotary cutters substantially independently of the centrifugal and gravitational forces.

* * * * *